US009174458B2

(12) United States Patent
Inukai

(10) Patent No.: US 9,174,458 B2
(45) Date of Patent: Nov. 3, 2015

(54) HEATING DEVICE FOR DETECTING STATE OF ADJUSTMENT PORTION THAT ADJUSTS PERIOD OF CONNECTION WITH ALTERNATING CURRENT SOURCE

(71) Applicant: BROTHER KOGYO KABUSHIKI KAISHA, Nagoya-shi, Aichi-ken (JP)

(72) Inventor: Katsumi Inukai, Iwakura (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/667,748

(22) Filed: Mar. 25, 2015

(65) Prior Publication Data

US 2015/0273859 A1 Oct. 1, 2015

(30) Foreign Application Priority Data

Mar. 28, 2014 (JP) ..... 2014-069250

(51) Int. Cl.
*B41J 2/35* (2006.01)
*B41J 2/355* (2006.01)

(52) U.S. Cl.
CPC ..... *B41J 2/355* (2013.01)

(58) Field of Classification Search
USPC ..... 347/5, 9, 12, 14, 188, 191, 192, 206, 347/208, 209, 210, 211; 400/120.09, 400/120.11, 120.15; 399/88
See application file for complete search history.

(56) References Cited

U.S. PATENT DOCUMENTS

| | | | | |
|---|---|---|---|---|
| 6,709,083 | B2 * | 3/2004 | Fukushima | 347/211 |
| 2005/0169659 | A1 * | 8/2005 | Koyama et al. | 399/88 |
| 2011/0242254 | A1 * | 10/2011 | Gu et al. | 347/192 |
| 2013/0136467 | A1 | 5/2013 | Naganawa | |
| 2013/0235098 | A1 * | 9/2013 | Umeda | 347/5 |

FOREIGN PATENT DOCUMENTS

| | | | |
|---|---|---|---|
| JP | 08-066005 | A | 3/1996 |
| JP | 2002-214965 | A | 7/2002 |
| JP | 2002-296955 | A | 10/2002 |
| JP | 2008-191372 | A | 8/2008 |
| JP | 2011-112684 | A | 6/2011 |
| JP | 2013-114147 | A | 6/2013 |

* cited by examiner

*Primary Examiner* — Kristal Feggins
(74) *Attorney, Agent, or Firm* — Merchant & Gould PC

(57) ABSTRACT

In a heating device, a heater has first and second terminals. The first terminal is connectable to an alternating current source. The adjustment portion selectively establishes and disconnects a first connection between the second terminal and the alternating current source. The switching portion selectively establishes and disconnects a second connection between the heater and the alternating current source. The generating circuit has a third terminal connected to the alternating current source and a fourth terminal connected between the second terminal and the adjustment portion. The generating circuit generates a zero-cross signal of the alternating current source. The processor is configured to: adjust a connection period during which the adjustment portion establishes the first connection; detect a state of the adjustment portion in response to the zero-cross signal; and perform an error process when the detected state of the adjustment portion indicates that the adjustment portion cannot disconnect the first connection.

12 Claims, 7 Drawing Sheets

HEATING DEVICE FOR DETECTING STATE OF ADJUSTMENT PORTION THAT ADJUSTS PERIOD OF CONNECTION WITH ALTERNATING CURRENT SOURCE

CROSS REFERENCE TO RELATED APPLICATION

This application claims priority from Japanese Patent Application No. 2014-069250 filed Mar. 28, 2014. The entire content of the priority application is incorporated herein by reference.

TECHNICAL FIELD

The present disclosure relates to a heating device and an image forming device that includes the heating device, and more specifically to a technique for dealing with an abnormality in a power source of the heating device.

BACKGROUND

A technique for dealing with an abnormality in the power source of the heating device is well known. In such a heating device, when voltage of abnormal waveform, such as square wave or direct current, is input, there is a possibility that a triac (power distribution adjustment member), which controls the supply of power to a heater, goes out of control. In order to deal with this problem, the heating device is provided with a circuit to detect an abnormal waveform. When the abnormal waveform is detected, the heating device cuts off the supply of power to the heater by controlling a relay.

SUMMARY

There is a case where the abnormal waveform is not so significant that the triac can be controlled. However, in the conventional heating device, the supply of power to the heater will be cut off by the relay once the waveform is judged to be abnormal. Thus, unnecessary down time may occur.

The present disclosure is intended to provide a technique for ensuring safety when the abnormal waveform is input while reducing the unnecessary downtime in the heating device.

In order to attain the above and other objects, the disclosure provides a heating device. The heating device includes a heater, an adjustment portion, a switching portion, a generating circuit, and a processor. The heater has a first terminal and a second terminal. The first terminal is configured to be connectable to one terminal of an alternating current source. The adjustment portion is configured to selectively establish and disconnect a first connection between the second terminal and another terminal of the alternating current source. The switching portion is configured to selectively establish and disconnect a second connection between the heater and the alternating current source. The generating circuit has a third terminal and a fourth terminal. The third terminal is connected to the one terminal of the alternating current source. The fourth terminal is connected between the second terminal and the adjustment portion. The generating circuit is configured to generate a zero-cross signal indicating a zero-cross timing concerning output of the alternating current source. The processor is configured to: adjust a connection period during which the adjustment portion establishes the first connection; detect a state of the adjustment portion in response to the zero-cross signal; and perform an error process when the detected state of the adjustment portion indicates that the adjustment portion cannot disconnect the first connection.

According to another aspect, the present disclosure provides an image forming device. The image forming device includes a heating device, an image forming unit, and a processor. The heating device includes a heater, an adjustment portion, a switching portion, and a generating portion. The heater has a first terminal and a second terminal. The first terminal is configured to be connectable to one terminal of an alternating current source. The adjustment portion is configured to selectively establish and disconnect a first connection between the second terminal and another terminal of the alternating current source. The switching portion is configured to selectively establish and disconnect a second connection between the heater and the alternating current source. The generating circuit has a third terminal and a fourth terminal. The third terminal is connected to the one terminal of the alternating current source. The fourth terminal is connected between the second terminal and the adjustment portion. The generating circuit is configured to generate a zero-cross signal indicating a zero-cross timing concerning output of the alternating current source. The image forming unit is configured to form an image on a recording sheet in response to image data. The processor is configured to: adjust a connection period during which the adjustment portion establishes the first connection; detect a state of the adjustment portion in response to the zero-cross signal; and perform an error process when the detected state of the adjustment portion indicates that the adjustment portion cannot disconnect the first connection.

BRIEF DESCRIPTION OF THE DRAWINGS

The particular features and advantages of the invention as well as other objects will become apparent from the following description taken in connection with the accompanying drawings, in which.

DETAILED DESCRIPTION

1. Configuration of Printer

Figure 1:
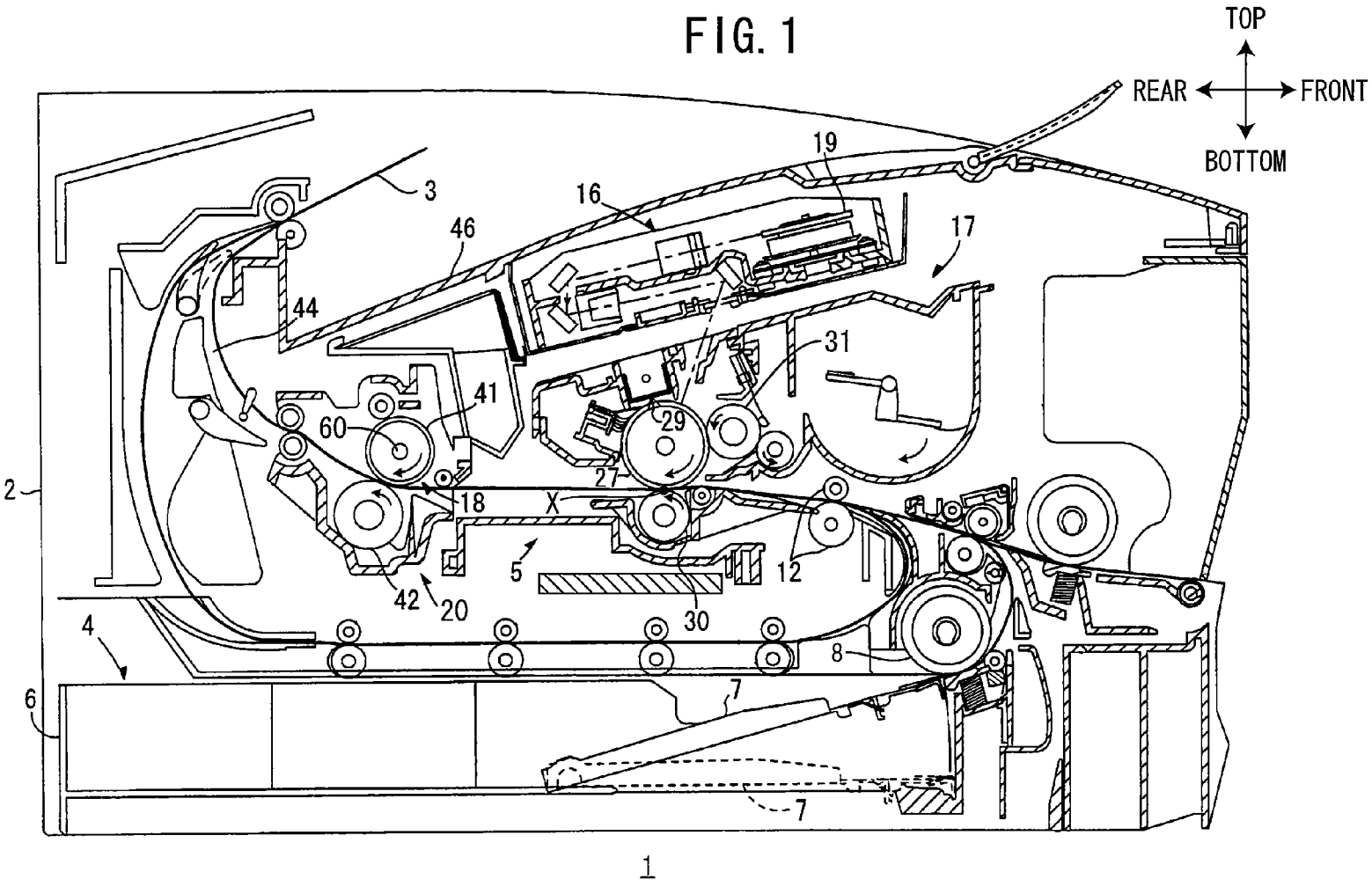
FIG. 1 is a cross sectional diagram illustrating a printer according to an embodiment.

As shown in FIG. 1, a monochrome laser printer 1 (referred to as "printer", hereinafter) includes a body frame 2, a paper feed unit 4, an image forming unit 5, and a fixing unit 18. The printer 1 is one example of an image forming device. The image forming device is not limited to the monochromatic laser printer. For example, the image forming device may be a color laser printer or a color LED printer. Moreover, the image forming device is not limited to the printer. The image forming device may be a facsimile machine or a multifunction peripheral.

The paper feed unit 4 includes a paper feed tray 6 on which recording sheets 3 (which are one example of "recording sheet") are placed; a pressing plate 7; and a paper feed roller 8. The pressing plate 7 can rotate about a rear end portion thereof. The recording sheets 3 on the pressing plate 7 are pressed against the paper feed roller 8. The rotation of the paper feed roller 8 feeds each of the recording sheets 3 to a conveying path.

The registration roller 12 correcting a skew (a posture) of the recording sheet 3 fed by the paper feed roller 8, and subsequently conveys the recording sheet 3 to a transfer position X. At the transfer position X, a toner image on a photosensitive drum 27 is transferred to the recording sheet 3. That is, at the transfer position X, the photosensitive drum 27 is in contact with a transfer roller 30.

The image forming unit 5 forms a toner image on the recording sheet 3. The image forming unit 5 includes a scanner unit 16 and a process cartridge 17. The scanner unit 16 includes a laser emission unit (not shown) and a polygon mirror 19. A laser beam emitted from the laser emission unit (indicated by alternate long and short dash line in the diagram) is deflected by the polygon mirror 19 and emitted to the surface of the photosensitive drum 27.

The process cartridge 17 includes a developing roller 31, the photosensitive drum 27, and a scorotron-type charger 29. The charger 29 charges the surface of the photosensitive drum 27 uniformly and positively. The positively-charged surface of the photosensitive drum 27 is exposed to the laser beam that is emitted from the scanner unit 16, and an electrostatic latent image is formed on the photosensitive drum 27. Then, the toner carried by the surface of the developing roller 31 is supplied to the electrostatic latent image formed on the photosensitive drum 27, whereby the image is developed.

Figure 3:
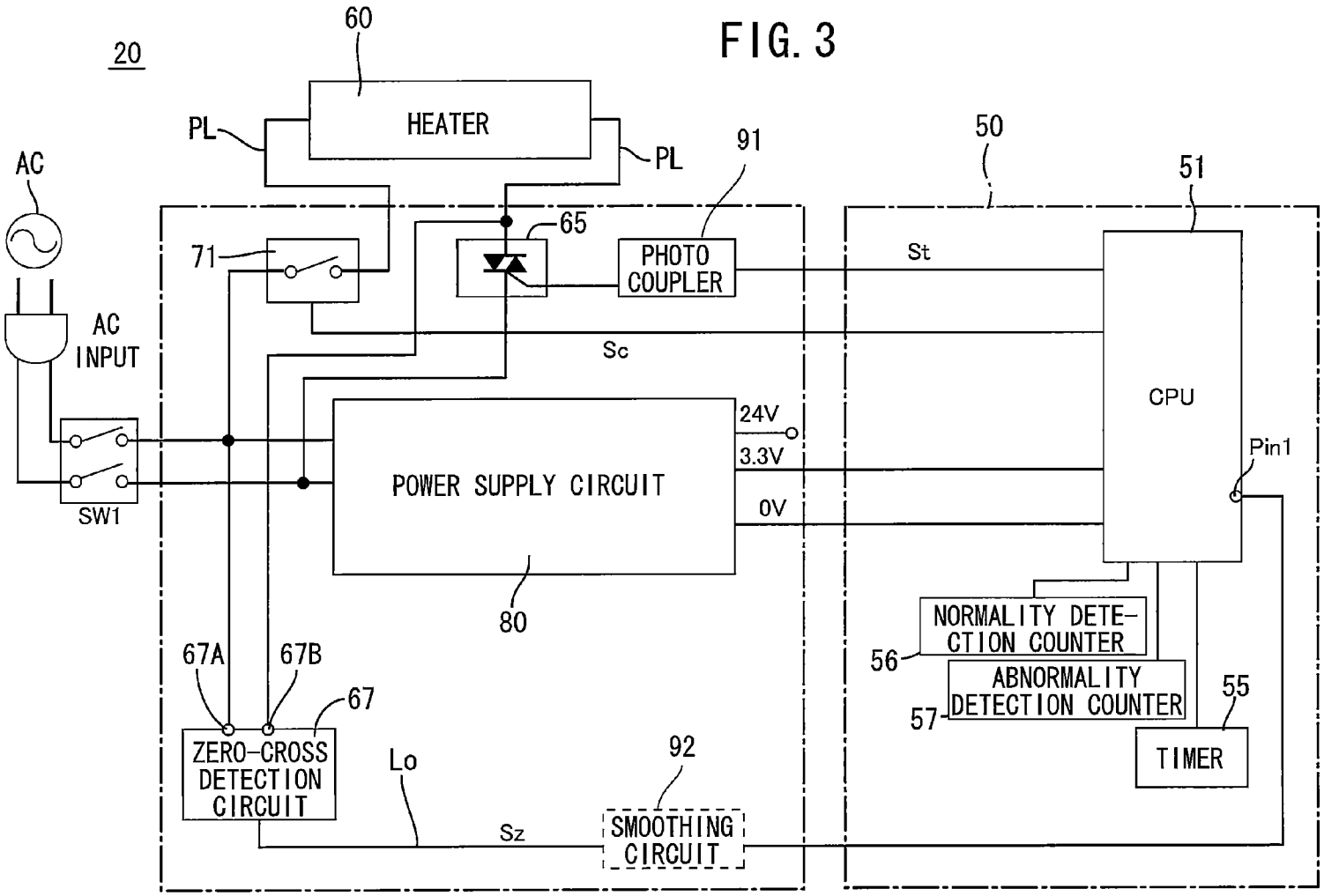
FIG. 3 is a block diagram of a heating device provided in the printer shown in FIG. 1.

As shown in FIGS. 1 and 3, the fixing unit 18 includes a heating roller 41, a pressing roller 42, and a heating device 20 including a heater 60. For example, the heater 60 is a halogen lamp, and is provided inside the heating roller 41. The heater 60 generates heat when power is supplied. The fixing unit 18 thermally fixes the toner image onto the recording sheet 3 when the recording sheet 3 passes between the heating roller 41 and the pressing roller 42. After the toner has been thermally fixed on the recording sheet 3, the recording sheet 3 is discharged onto a discharge tray 46 through a discharge path 44.

Figure 2:
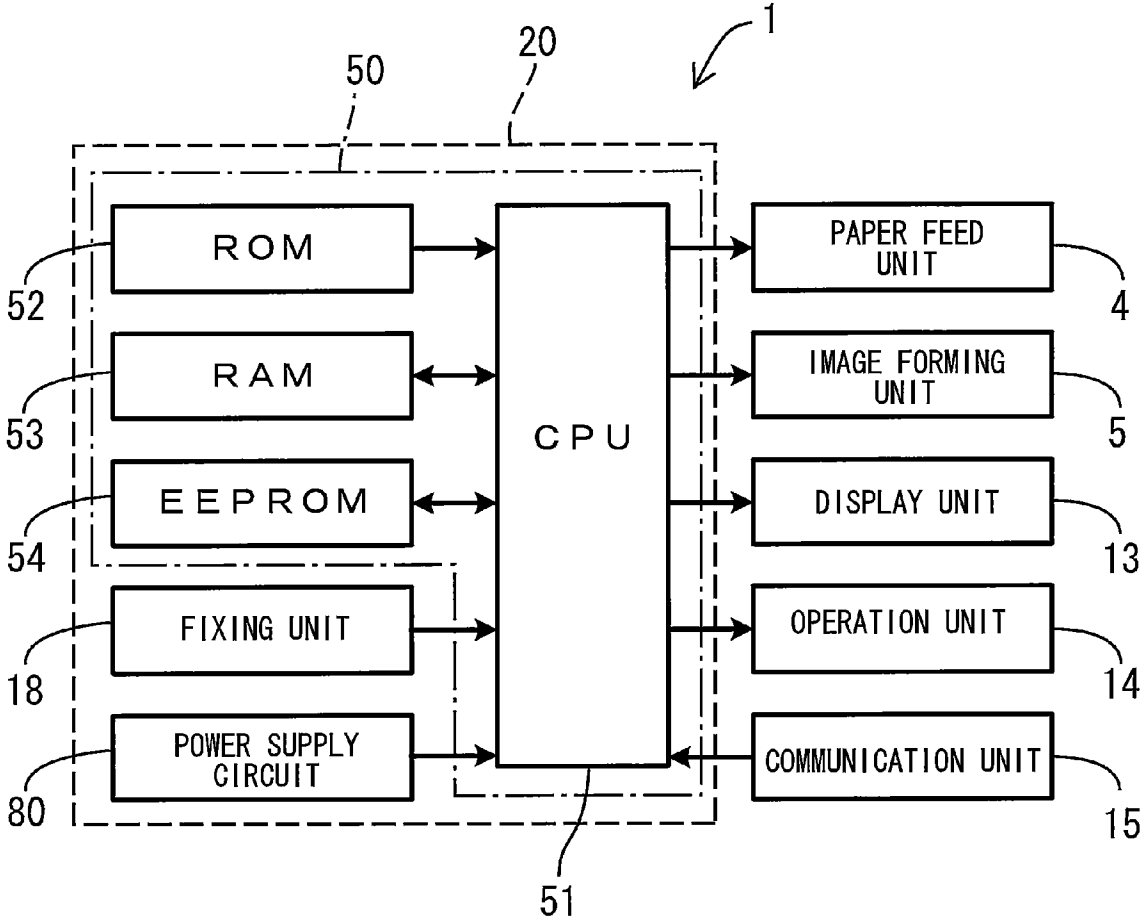
FIG. 2 is a block diagram of the printer shown in FIG. 1.

FIG. 2 shows an electric configuration of the printer 1. The printer 1 includes a control unit 50, the paper feed unit 4, the image forming unit 5, the fixing unit 18, a display unit 13, an operation unit 14, a communication unit 15, and a power supply circuit 80. The control unit 50 is one example of "processor". The control unit 50 includes a CPU 51, a ROM 52, a RAM 53, and an EEPROM 54. The control unit 50 includes an ASIC (application specific integrated circuit) that contains the CPU 51. However, the control unit 50 is not limited to the ASIC.

The CPU 51 controls each part of the printer 1 by executing various programs stored in the ROM 52. The CPU 51 performs a plurality of control functions. Among the plurality of control functions, a control function for controlling the heating device 20 will be described later.

The ROM 52 stores various programs that the CPU 51 executes, as well as data that the CPU 51 accesses during each of various processes. The RAM 53 serves as a main storage device that the CPU 51 uses to perform each of the various processes. The EEPROM 54 is a nonvolatile memory that can hold data even when power supply to the EEPROM 54 is interrupted. The EEPROM 54 stores various kinds of setting data.

The display unit 13 includes various lamps and a liquid crystal panel. The operation unit 14 includes an input panel. A user can issue a print command by watching the display unit 13 and operating the operation unit 14. The communication unit 15 exchanges data with an external information terminal device (not shown).

The printer 1 further includes a network interface (not shown) to be connected to an external device (not shown). Accordingly, a user can issue an input command via the network interface from the external device.

2. Configuration of Heating Device

As shown in FIG. 3, the heating device 20 includes, a triac 65, a zero-cross detection circuit 67, a relay 71, a power switch SW1, the control unit 50, and the power supply circuit 80 in addition to the heater 60. The control unit 50 includes a timer 55, a normality detection counter 56, and an abnormality detection counter 57, as well as the CPU 51, the ROM 52 and so on (see FIG. 2).

The heating device 20 further includes a power supply path PL that connects an AC power source AC and the heater 60. The triac 65 is disposed on the power supply path PL between the heater and the AC power source AC. The triac 65 is connected to the output side (terminal) of the heater 60. That is, the output side of the heater 60 is opposite to a terminal of the heater 60 that is connected to the AC power source AC. That is, the AC power source AC, the heater 60, and the triac 65 are connected in series in this order. The output side (terminal) of the triac 65 is connected to ground. The triac 65 switches on and off the power supply to the heater 60 from the AC power source AC. The triac 65 is turned on in response to a heater control signal St that is output from the CPU 51 and input via a photo coupler 91, thereby allowing the power to be supplied to the heater 60. The triac 65 is turned off when the current comes to zero, thereby cutting off the power supply to the heater 60. That is, the triac 65 selectively establishes and disconnects a connection between the heater 60 and a terminal of the AC power source AC that is connected to the ground. The triac 65 is one example of "adjustment portion".

Figure 7:
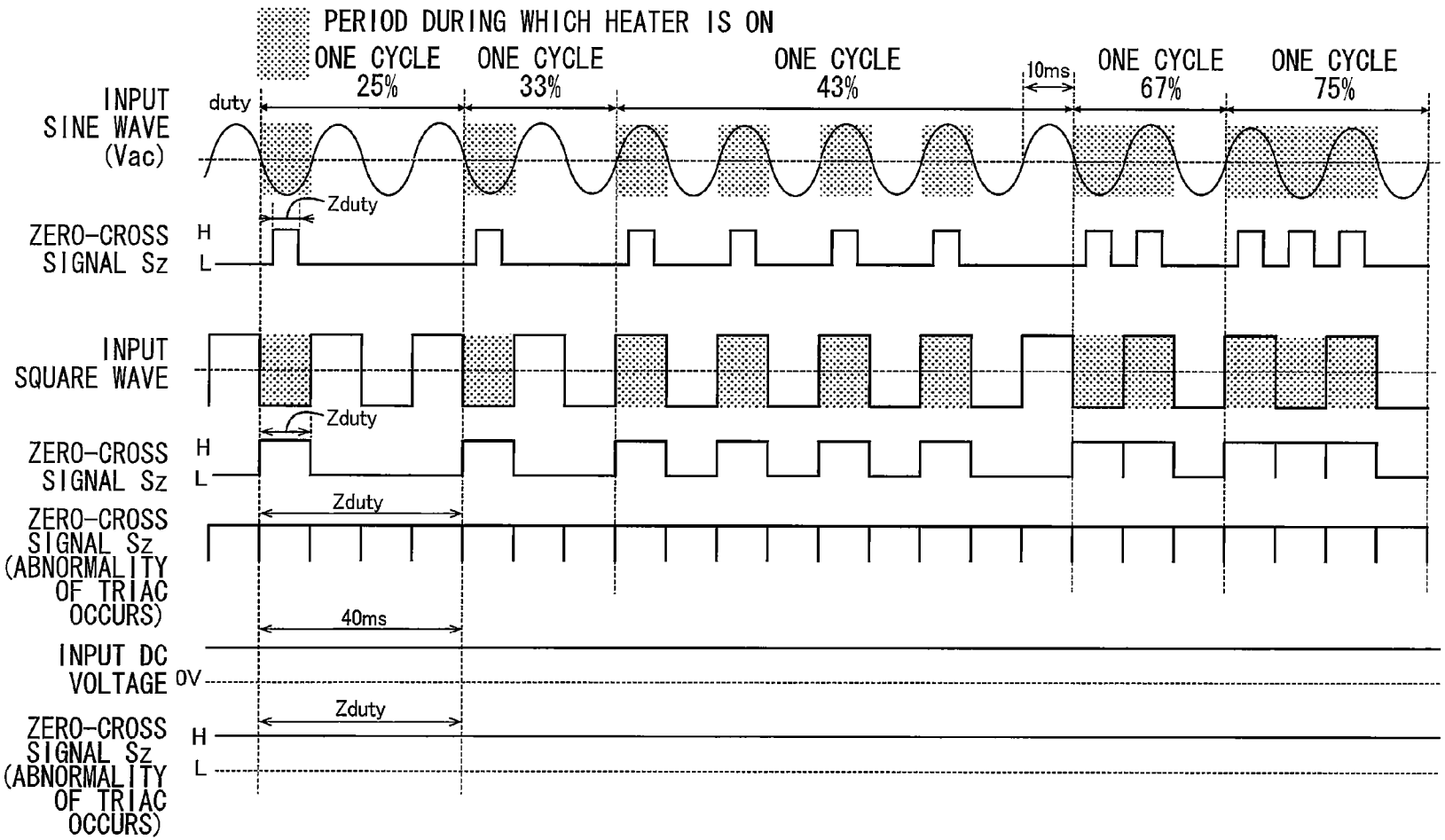
FIG. 7 is timing charts concerning the triac operation abnormality detection process.

According to the embodiment, as shown in FIG. 7, in the power supply process, the triac 65 controls the power supply to the heater 60 from the AC power source AC on the basis of a wave number control. The wave number control controls the number of waves of an AC voltage Vac on a half-wave basis. Here, the AC voltage Vac is an output voltage of the AC power source AC. For example, as shown in FIG. 7, in a case where the triac 65 is turned on during a half-wavelength period in each of four half-wavelength period. In this case, wavenumber duty (DUTY) by the wavenumber control is 25%. If the triac 65 is turned on during a half-wavelength period in each three half-wavelength period, the wavenumber duty is 33%. FIG. 7 also shows other cases such as when the wavenumber duty is 43%, 67%, or 75%. In the wave number control, the CPU 51 sets the wavenumber duty on the basis of the temperature or other states of the heater 60.

The power-supply control by the triac 65 may be performed by a method other than the wavenumber control. For example, the power-supply control may be carried out by conduction-angle control (phase control) of the AC voltage Vac.

As shown in FIG. 3, the relay 71 is provided on the power supply path PL as in the case of the triac 65. That is, the relay 71 is provided between the AC power supply AC and the input side of the heater 60. The relay 71 switches on and off to establish and disconnect a connection between the AC power source AC and the heater 60. That is, the relay 71 is used to protect the heater 60. The relay 71 is turned off in response to a switching signal Sc supplied from the CPU 51. That is the relay 71 has a function of cutting off the power supply to the heater 60. In other words, the relay 71 selectively establishes and disconnects a connection between the AC power supply AC and the input side of the heater 60. The relay 71 is one example of a "switching portion".

Figure 4:
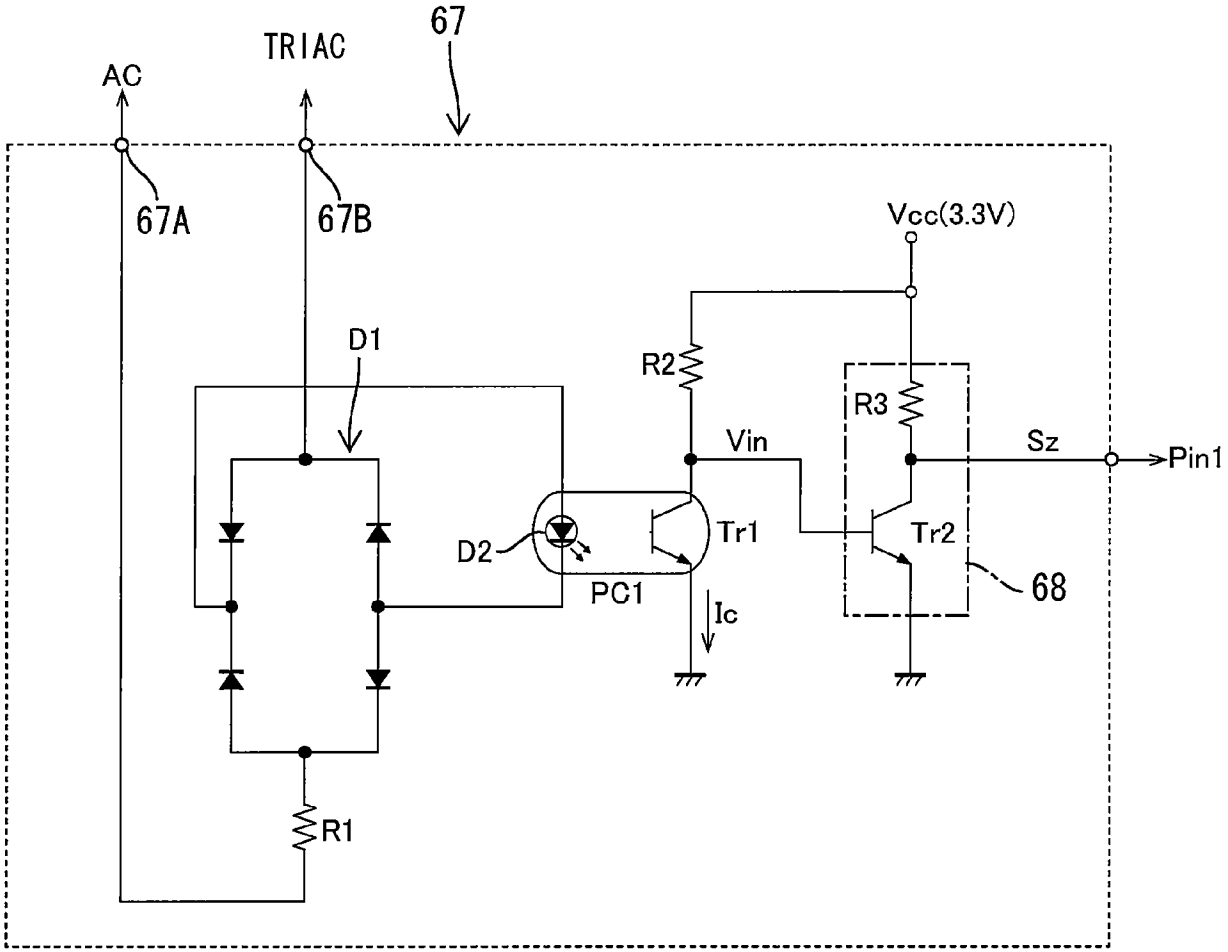
FIG. 4 is a circuit diagram illustrating an example of a zero-cross detection circuit.

As shown in FIG. 4, the zero-cross detection circuit 67 includes terminals 67A and 67B, a resistor R1, a full-wave rectifier bridge circuit D1, a photo coupler PC1, a resistor R2, and an inverting circuit 68. The terminal 67A is connected to the input terminal of the relay 71 that is connected to the AC power source AC. The another terminal 67B is connected between the output terminal of the heater 60 and the triac 65. More specifically, as shown in FIGS. 3 and 4, one terminal of the full-wave rectifier bridge circuit D1 in the zero-cross detection circuit 67 is connected to the input terminal of the relay 71, via the resistor R1 and the terminal 67A. The other terminal of the full-wave rectifier bridge circuit D1 is connected between the heater 60 and the triac 65, via the terminal (which is one example of the "other terminal") 67B. The zero-cross detection circuit 67 generates a zero-cross signal Sz. The zero-cross signal Sz is rectangular-pulse synchronized with a zero-cross timing of the AC voltage. The zero-cross detection circuit 67 is one example of a "generation circuit". The terminal 67A is one example of "one terminal". The terminal 67B is an example of the "another terminal".

According to the above-described connection configuration of the zero-cross detection circuit 67, the zero-cross detection circuit 67 is connected to the AC power source AC even if the relay 71 is turned off. Accordingly, in the case of the embodiment, even when the relay 71 is off or when power is not supplied to the heater 60, the zero-cross detection circuit 67 can generate the zero-cross signal Sz. An abnormality in the waveform of the AC power source can be detected on the basis of the zero-cross signal Sz. Further, an abnormality in the operation of the triac 65, or a failure to turn off the triac 65 due to the abnormality in the waveform of the AC power source, can be detected on the basis of the zero-cross signal Sz. In this manner, the power required for the abnormality detection process can be reduced.

As shown in FIG. 4, the full-wave rectifier bridge circuit D1 carries out full-wave rectification of output voltage V of the AC power source AC. The photo coupler PC 1 includes a light-emitting diode D2 and a phototransistor Tr1. The light-emitting diode D2 is connected to the full-wave rectifier bridge circuit D1.

The emitter of the phototransistor Tr1 is connected to the ground, and the collector is connected to a DC power supply line Vcc via the resistor R2. The inverting circuit 68 is connected to the collector of the phototransistor Tr1. The inverting circuit 68 inverts a voltage level of the collector (High/Low) and outputs the inverted voltage.

Figure 5:
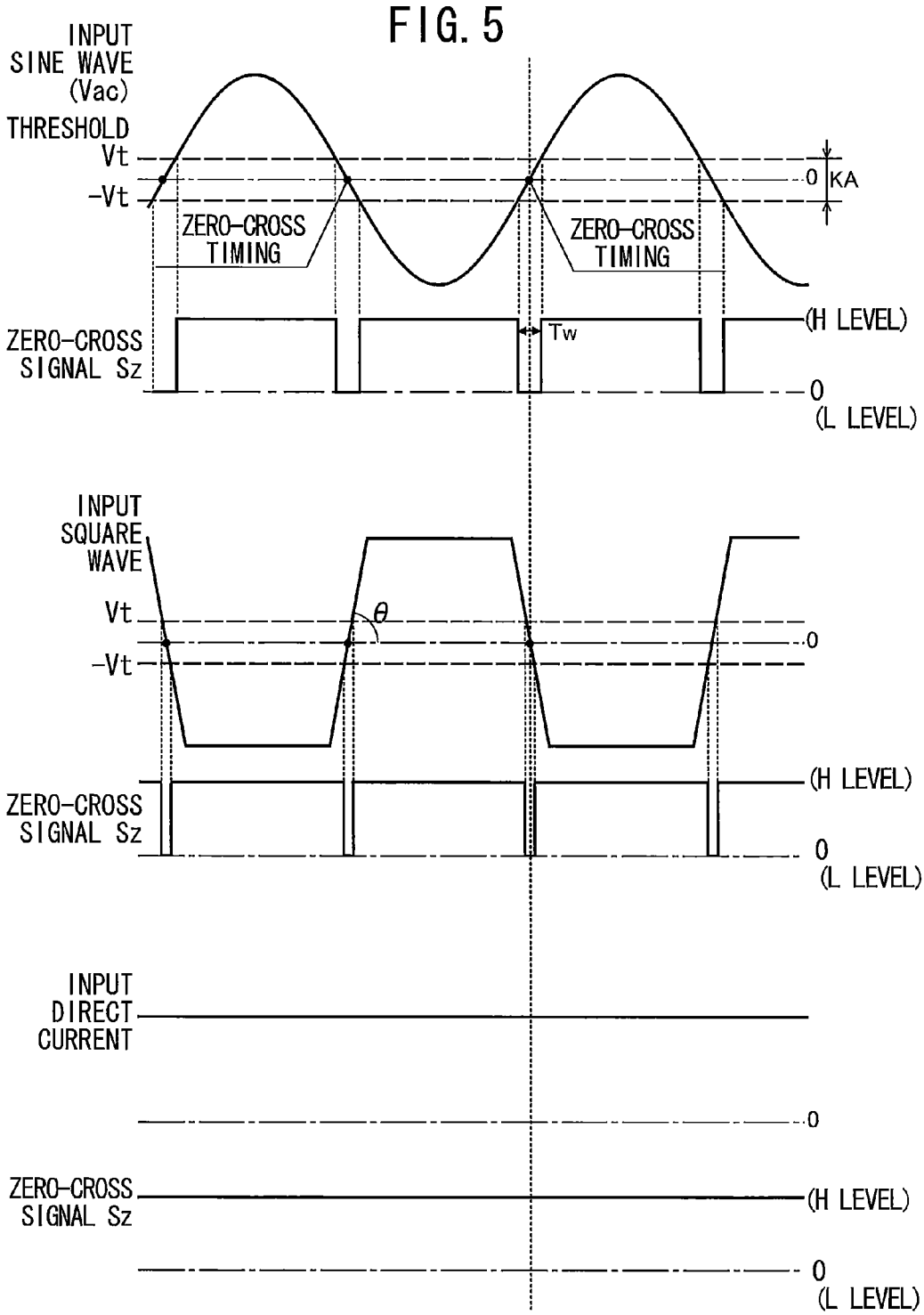
FIG. 5 is graphs of power output from a power supply and graphs of zero-cross signals.

The amount of light emission by the light-emitting diode D2 decreases as the AC voltage Vac becomes smaller. As a result, current Ic that flows through the phototransistor Tr1 decreases, and input voltage Vin of the inverting circuit 68 therefore increases. As shown in FIG. 5, when the AC voltage Vac drops below a threshold value Vt, a low level is output from the inverting circuit 68.

The amount of light emission by the light-emitting diode D2 increases as the AC voltage Vac becomes larger. As a result, the current Ic that flows through the phototransistor Tr1 increases, and the input voltage Vin of the inverting circuit therefore decreases. When the AC voltage Vac exceeds the threshold value Vt, a high level is output from the inverting circuit 68.

In this manner, as shown in FIG. 5, during the period in which AC (Sine wave) voltage Vac is within a zero-cross detection range KA defined by +Vt and −Vt, the zero-cross detection circuit 67 outputs a zero-cross signal Sz with a pulse width of Tw. More specifically, the zero-cross detection circuit 67 outputs a rectangular-pulse zero-cross signal Sz whose signal level is "low level". As shown in FIGS. 3 and 4, an output line Lo of the zero-cross detection circuit 67 is connected to an input port Pin1 of the CPU 51, and the CPU 51 detects the zero-cross signal Sz. FIG. 3 shows a smoothing circuit 92. However, the heating device 20 of the embodiment does not includes the smoothing circuit 92, and thus the output line Lo of the zero-cross detection circuit 67 is directly connected to the input port Pin 1, in this embodiment. The smoothing circuit 92 will be used in a modification of the embodiment explained later.

In the case of the embodiment, the inverting circuit 68 includes an emitter-common transistor Tr2 and a resistor R3 that is connected to the collector of the transistor Tr2. However, the inverting circuit 68 may be a single IC having the same function, or the inverting circuit 68 may be omitted. According to the embodiment, the zero-cross detection circuit 67 is configured to output an active low. However, the zero-cross detection circuit 67 is not limited to this configuration. The zero-cross detection circuit 67 may be configured to output an active high.

On the basis of the zero-cross signal Sz inputted to the CPU 51 via the input port Pin1, the CPU 51 turns the triac 65 on or off by outputting a heater control signal St, thereby changing the above-described wavenumber duty. In this manner, the CPU 51 controls the amount of power supplied to the heater 60 in such a way that the temperature of the heater approaches a target temperature.

The CPU 51 controls the relay 71 to perform a switching process, a first adjustment process, a detection process, and an error process, on the basis of the switching signal Sc as described later. The switching process switches the connection between the AC power source AC and the heater 60. The first adjustment process adjusts, with reference to the zero-cross signal Sz, a period of time during which the triac 65 is turned on when the AC power source AC is not connected to the heater 60. During the first adjustment process, the detection process detects the state of the triac 65 (detects whether the triac 65 is turned on or off), on the basis of the zero-cross signal Sz. The error process performs an error operation when the detection process detects a state where the triac 65 cannot be turned off.

For example, the power supply circuit 80 includes a well-known switching regulator. The power supply circuit 80 converts AC voltage Vac to DC voltage DC. For example, the power supply circuit 80 outputs a 24V DC voltage DC and a 3.3V DC voltage DC.

3. Operational Abnormality of Triac

As described above, the heater 60 is supplied with power from the AC power source AC, and the power supply to the heater 60 is controlled. The printer 1 is configured to receive a sine wave AC power source of commercial frequency. However, DC (direct current) voltage, or square-wave (rectangular-wave) voltage with a faster rising speed of voltage, could be supplied to the printer 1 due to a malfunction of the power source or any other trouble.

If the square-wave voltage is input, the triac 65 cannot be turned off because a change in voltage of the square wave is larger around a zero-cross point than that of a sine wave. Thus, there is a possibility that the triac 65 remains on, and the amount of power supplied to the heater 60 is out of control. The faster rising speed of voltage reflects the situation where angle θ in FIG. 5 is about 90 degrees. If DC voltage is input, the triac 65 cannot be turned off because a reverse voltage is not applied. Thus, the triac 65 will remain on, and that the amount of power supplied to the heater 60 will be out of control.

That is, as shown in FIG. 5, if an AC power source AC outputting a square-wave voltage is connected, the pulse width Tw of the zero-cross signal Sz could become narrower than a normal range, or an even narrower pulse width could make it impossible to output the zero-cross signal Sz. If DC voltage is input, as shown in FIG. 5, the zero-cross signal Sz is constantly at High (H) Level, and the pulse is not output.

According to the embodiment, the CPU 51 detects the pulse width or other factors of the zero-cross signal Sz in order to determine whether the triac 65 is in a normally operating state, or is in an out-of-control abnormal state where the triac 65 cannot be turned off.

4. Triac Operation Abnormality Detection Process

Figure 6:
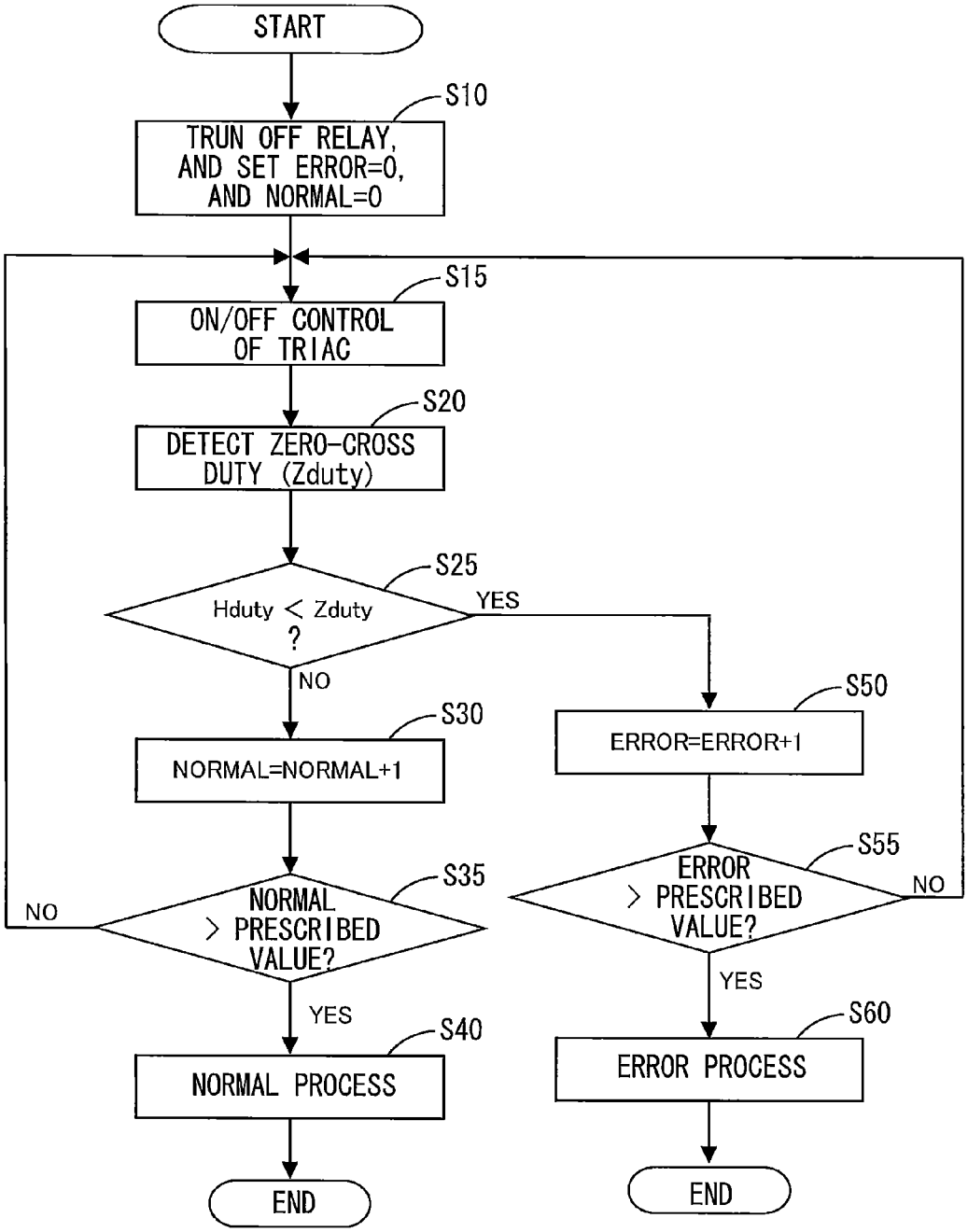
FIG. 6 is a flowchart illustrating a triac operation abnormality detection process.

With reference to FIGS. 6 and 7, the above-described detection process (specifically, a triac operation abnormality detection process) executed by the CPU 51 of the control unit 50 will be described. In the detection process, the CPU 51 detects an abnormality in the operation of the triac 65. That is, the triac operation abnormality detection process detects an abnormality, or the situation where the triac 65 cannot be turned off due to an abnormal waveform of the power source. For example, this process starts after the power switch SW1 is turned on and the AC power source AC begins to supply power to the printer 1. In other words, this process is executed when the printer 1 is turned on.

In S10, the CPU 51 turns the relay 71 off by outputting the switching signal Sc (this process is one example of a "switching process"), resets a count value NORMAL of the normality detection counter 56 to zero, and resets a count value ERROR of the abnormality detection counter 57 to zero.

In S15, the CPU 51 performs an ON/OFF control of the triac 65 by outputting the heater control signal St (this process is one example of a "first adjustment process"). That is, when the AC power source AC is not connected to the heater 60, the CPU 51 adjusts the period of time during which the triac 65 is turned on, with reference to the zero-cross signal Sz. According to the embodiment, the CPU 51 performs the wavenumber control (See FIG. 7) with a wavenumber duty 25% for the triac 65, for example, in order to adjust the period of time during which the triac 65 is turned on. The wavenumber duty is not limited to 25%. The wavenumber duty may be 33%, for example. Furthermore, a process to adjust the period of time during which the triac 65 is turned on is not limited to the wavenumber control. Any process for adjusting the period of time during which the triac 65 is turned on may be performed. That is, any process for turning the triac 65 on/off may be performed.

In S20, the CPU 51 detects a on or off state of the triac 65 on the basis of the zero-cross signal Sz. More specifically, on the basis of the time period measured by the timer 55, the CPU 51 detects zero-cross DUTY (Zduty), or duty ratio of the zero-cross signal Sz, as shown in FIG. 7. In this case, the zero-cross DUTY (Zduty) corresponds to a high-level period of the zero-cross signal Sz. Specifically, the zero-cross DUTY (Zduty) indicates the ratio of the high-level period of the zero-cross signal Sz to a one-cycle period defined by the wavenumber control. In the embodiment, the zero-cross DUTY (Zduty) is regarded as a high-level period of the zero-cross signal Sz. That is, the zero-cross DUTY (Zduty) has a measure of time. To detect the zero-cross signal Sz, at first the CPU 51 sends the heat control signal St to the photo coupler 91. In this case, a high-level period of the heat control signal St is shorter than one-cycle period defined by the wavenumber control, for example. Upon receipt of the heat control signal St, the triac 65 is turned on, thus the zero-cross detection circuit 67 can detects the zero-cross timing of the voltage applied to the triac 65. When the zero-cross timing is not detected in the zero-cross signal Sz, the CPU 51 determines that the zero-cross DUTY (Zduty) is 100%. When the zero-cross timing is detected, next the CPU 51 generates the heat control signal St on the basis of the detected zero-cross timing and the wavenumber duty, and outputs the generated heat control signal St to the photo coupler 91. The CPU 51 further detects the voltage applied to the triac 65 for one-cycle period on the basis of the zero-cross signal Sz and determines the zero-cross DUTY (Zduty). Note that FIG. 5 shows an example where every zero-cross timings are detected, whereas FIG. 7 shows an example where zero-cross timings in accordance with the set wavenumber duty is detected. For example, in FIG. 7, in a cycle having the duty 25%, the zero-cross signal Sz is high only within a period of half wavelength and the zero-cross signal is low in a remaining periods of three half wavelength. This is, because in FIG. 7, the zero-cross timings are detected according to the heat control signal St that is set depending on the wavenumber duty. In other words, the zero-cross signal Sz shown in FIG. 5 indicates a signal generated when the wavenumber duty controlled by the heat control signal St is 100%.

In S25, the CPU 51 determines whether or not the detected zero-cross DUTY (Zduty) is larger than a wavenumber DUTY (Hduty). The wavenumber DUTY (Hduty) indicates a period of time during which the triac 65 is turned on in one cycle of a prescribed wavenumber duty set by the wavenumber control. The processes S20 and S25 are one example of a detection process detecting the on or off state of the triac 65 on the basis of the zero-cross signal Sz.

A range of zero-cross DUTY (Zduty) that is less than or equal to the wavenumber DUTY (Hduty) is a "specified range." A range of zero-cross DUTY (Zduty) that is greater than the wavenumber DUTY (Hduty) is "out of the specified range".

The determination process of step S25, that is, the determination of the specified range, is not limited to this example. For example, the specified range may be smaller than equal to "Hduty+α (α is a prescribed time period)" so that the specified range can be longer than the wavenumber DUTY (Hduty). Alternatively, the specified range may be smaller than or equal to "Hduty*β (β is a real number greater than 1)" so that the specified range can be longer than the wavenumber DUTY (Hduty).

For example, the wavenumber DUTY (Hduty) is 10 ms when AC frequency is 50 Hz and the wavenumber duty is 25%. When the wavenumber duty is 33%, the wavenumber DUTY (Hduty) is 10 ms. When the wavenumber duty is 43%, the wavenumber DUTY (Hduty) is 40 ms. When the wavenumber duty is 67%, the wavenumber DUTY (Hduty) is 20 ms. When the wavenumber duty is 75%, the wavenumber DUTY (Hduty) is 30 ms (See FIG. 7).

If the CPU 51 determines that the zero-cross DUTY (Zduty) is not greater than the wavenumber DUTY (Hduty) (S25: No), in S30 the CPU 51 determines that the triac 65 is properly turned off, and increments the count value NORMAL of the normality detection counter 56 by one.

In S35, the CPU 51 determines whether or not the count value NORMAL is greater than a prescribed count value. For example, the prescribed count value is set to "5". If the CPU 51 determines that the count value NORMAL is not greater than the prescribed count value (S35: NO), the CPU 51 goes back to S15 and performs the process S15 and subsequent processes for the next cycle with respect to the wavenumber control.

If the CPU 51 determines that the count value NORMAL is greater than the prescribed count value (S35: YES), in S40 the CPU 51 determines that the triac 65 is in a normal operating states with respect to the AC power source AC, and performs a normal process.

The CPU 51 performs, for example, a normal process associated with the heating by the heater 60. In the normal process associated with the heating by the heater 60, for example, the CPU 51 switches the relay 71 by outputting the switching signal Sc, thereby connecting the AC power source AC to the heater 60. Then, with reference to the zero-cross signal Sz, the CPU 51 performs the wavenumber control so as to adjust the period of time during which the triac 65 is turned on by outputting the heat control signal St. In this manner, the CPU 51 adjusts the period of time during which power is supplied to the heater 60 from the AC power source AC. This normal process associated with the heating by the heater 60 is one example of a "second adjustment process".

The CPU 51 performs, for example, a normal process associated with an image forming operation. In the normal process associated with the image forming operation, while the heater 60 is controlled by the second adjustment process, the CPU 51 controls the image forming unit 5 to form an image in response to a print command that is input via the communication unit 15, for example.

If the CPU 51 determines that the zero-cross DUTY (Zduty) is greater than the wavenumber DUTY (Hduty) (S25: YES), in S50 the CPU 51 determines that the triac 65 is not properly turned off, and increments the count value ERROR of the abnormality detection counter 57 by one.

In S55, the CPU 51 then determines whether or not the count value ERROR is greater than a prescribed count value. For example, the prescribed count value is set to "5". If the CPU 51 determines that the count value ERROR is not greater than the prescribed count value (S55: NO), the CPU 51 goes back to S15 and performs the process S15 and subsequent processes for the next cycle with respect to the wavenumber control.

If the CPU 51 determines that the count value ERROR is greater than the prescribed count value (S55: YES), the CPU 51 determines that the triac 65 cannot be turned off. That is, if the CPU 51 detects the zero-cross signal Sz whose duty ratio is out of the specified range, the CPU 51 detects the state where the triac 65 cannot be turned off. Accordingly, in S60 the CPU 51 performs an error process. In this case, the CPU 51 can easily detect the state where the triac 65 cannot be turned off, by checking the duty ratio of the zero-cross signal.

In the error process, for example, the CPU 51 prohibits the AC power source AC from being connected to the heater 60 by the switching process of the relay 71. Accordingly, for example, even if the square-wave voltage or DC voltage is input from the AC power source, and the CPU 51 detects the state where the power supply to the heater 60 cannot be stopped by the triac 65 (that is, the triac 65 cannot be turned off), the CPU 51 can prevent a rise in the temperature of the heater 60.

In the error process, for example, the CPU 51 controls the display unit 13 to output error information indicating that the triac 65 is in abnormal state where the triac 65 cannot be turned off. In this manner, the CPU 51 can warn a user of the abnormality of the triac 65 due to the abnormal waveform of the power source. The display unit 14 is one example of a "notification unit".

In the error process, for example, the CPU 51 prohibits the image forming unit 5 from starting the image forming operation. In this manner, the CPU 51 prohibits the image forming operation during an abnormal state where the triac 65 cannot be turned off due to the abnormal waveform of the AC power source AC. As the result, the CPU 51 can prevent malfunction of the fixing unit, and thus prevent an improper image formation caused by the malfunction of the fixing unit 18.

5. Advantageous Effects of Embodiment

The CPU 51 determines whether the operation of the triac 65 is in a normal state or an abnormal state on the basis of the operation of the triac 65, while power is not supplied to the heater 60. If the CPU 51 has determined that the operation of the triac 65 is in the abnormal state, the CPU 51 performs the error process. Therefore, the CPU 51 can avoid an unnecessary downtime of the heating device 20 and reduce power consumption, and can ensure safety when an abnormal waveform is input.

That is, according to the embodiment, the CPU 51 checks the operation of the triac 65 with respect to the AC power source AC when the relay 71 is off and the heater 60 is not heated. Therefore, this configuration can more effectively reduce power consumption, than cases where the CPU 51 checks the AC power source AC or the operation of the triac 65 with respect to the AC power source AC while the AC power source AC is connected to the heater 60 for supplying the power to the heater 60.

Further, the configuration of the embodiment can more appropriately prevent the error process associated with the abnormal waveform from being executed unnecessarily, than cases where the CPU 51 simply determines whether or not the waveform of the power source is normal on the basis of the pulse width of the zero-cross signal Sz and stops the operation of the triac 65 if the CPU 51 determines that the waveform is abnormal. That is, for example, even when a square-wave voltage is input, the triac 65 can be turned off in some cases, depending on the shape of the square wave. In such cases, the error process associated with the abnormal waveform is not necessarily required. Therefore, the normal process does not have to be interrupted by the error process. In the embodiment, when the triac 65 can be turned off, the CPU 51 performs the normal process. In this manner, the unnecessary downtime can be reduced.

For example, when DC (direct current) is input from the power source and the triac 65 therefore cannot be turned off, the CPU 51 detects this state and performs the error process to notify of the abnormality of the triac 65. Therefore, a user can take steps to deal with the abnormality. Accordingly, this configuration can ensure safety when an abnormal waveform is input.

6. Modifications

While the description has been made in detail with reference to the embodiment thereof, it would be apparent to those skilled in the art that various changes and modifications may be made therein without departing from the scope of the above described embodiment.

(1) In the above embodiment, in the process S25 (detection process), the CPU 51 (processor) detects the state where the power supply to the heater 60 cannot be stopped by the triac 65 (adjustment portion), or the state where the triac 65 cannot be turned off when the CPU 51 has detected the zero-cross signal Sz whose duty ratio is out of the specified range. However, the embodiment is not limited to this. During the detection process, the zero-cross signal Sz may be smoothed and the smoothed zero-cross signal Sz may be detected. In this case when a voltage value of the smoothed zero-cross signal Sz is out of the specified range, the CPU 51 detects a state where the triac 65 cannot be turned off, and then execute the error process.

For example, as shown in FIG. 3, a smoothing circuit 92 is provided between the zero-cross detection circuit 67 and the CPU 51. The smoothing circuit 92 smooths the zero-cross signal Sz. The CPU 51 receives the smoothed signal from the smoothing circuit 91 and determines a voltage of the smoothed signal.

Even in this case, the CPU 51 can detect the state where the triac 65 cannot be turned off, by checking the voltage value of the smoothed zero-cross signal Sz. In this case, the process of turning the triac 65 on/off (power-supply adjustment) is controlled by the wavenumber control. If the voltage value of the smoothed zero-cross signal Sz is greater than a voltage value determined by a prescribed wavenumber duty in one cycle, the CPU 51 can detect that the triac 65 cannot be turned off. Since an error of the wavenumber duty could be caused during the wavenumber control, the use of the voltage value of the smoothed zero-cross signal Sz is effective when the power-supply adjustment of the triac 65 is performed by the wavenumber control.

(2) In the above-described embodiment, during the triac operation abnormality detection process, the process for turning the relay 71 off (S10) is performed when the printer 1 is turned on. However, the embodiment is not limited to this. The embodiment can skip the process for turning the relay 71 off if the relay 71 remains off when the printer 1 is turned on.

The embodiment is based on the concept that the detection process is performed with the relay 71 being turned off when there is no need to turn the relay on. However, the embodiment may be applied to cases where the detection process is performed with the relay 71 being turned on when there is a need to turn the relay 71 on, for example, a case where preparations are being made for printing or a case where the printing operation is started. In this case, more power is consumed than when the detection process is performed with the relay 71 being turned off, because the relay 71 is turned on. However, the relay 71 needs to be turned on in the first place in order to perform the printing preparation operation or the printing operation. Accordingly, less power is consumed compared with cases where the detection process is performed with the relay 71 being turned on when there is no need to turn the relay 71 on.

What is claimed is:

1. A heating device comprising:

a heater having a first terminal and a second terminal, the first terminal being configured to be connectable to one terminal of an alternating current source;

an adjustment portion configured to selectively establish and disconnect a first connection between the second terminal and another terminal of the alternating current source;

a switching portion configured to selectively establish and disconnect a second connection between the heater and the alternating current source;

a generating circuit having a third terminal and a fourth terminal, the third terminal being connected to the one terminal of the alternating current source, the fourth terminal being connected between the second terminal and the adjustment portion, the generating circuit being configured to generate a zero-cross signal indicating a zero-cross timing concerning output of the alternating current source; and a processor configured to:

adjust a connection period during which the adjustment portion establishes the first connection;

detect a state of the adjustment portion in response to the zero-cross signal; and perform an error process when the detected state of the adjustment portion indicates that the adjustment portion cannot disconnect the first connection.

2. The heating device according to claim 1, wherein the processor adjusts the connection period while the switching portion disconnects the second connection.

3. The heating device according to claim 1, wherein when performing the error process, the processor is configured to control the switching portion to disconnect the second connection.

4. The heating device according to claim 1, further comprising a notification unit, wherein when performing the error process, the processor is configured to control the notification unit to notify an occurrence of the error.

5. The heating device according to claim 1, wherein the processor is configured to:

receive the zero-cross signal;

determine a duty cycle of the zero-cross signal; and determine that the state of the adjustment portion indicates that the adjustment portion cannot disconnect the first connection when the duty cycle is out of a prescribed first range, wherein when determining that that the state of the adjustment portion indicates that the adjustment portion cannot disconnect the first connection, the processor performs the error process.

6. The heating device according to claim 1, further comprising a smoothing circuit connected between the generating circuit and the processor, the smoothing circuit being configured to smooth the zero-cross signal and output the smoothed zero-cross signal, wherein the processor is further configured to determine whether a voltage of the smoothed zero-cross signal is within a prescribed second range, wherein the processor performs the error process when the voltage of the smoothed signal is out of the prescribed second range.

7. The heating device according to claim 1, wherein the processor adjusts the connection period by performing a wave number control such that the connection period is adjusted in response to a number of waves having a prescribed wave size concerning the output of the alternating current source.

8. The heating device according to claim 1, wherein the processor is configured to further perform a normal process that heats the heater when the detected state of the adjustment portion indicates that the adjustment portion can disconnect the first connection.

9. The heating device according to claim 8, wherein when performing the normal process, the processor is further configured to control the switching portion to establish the second connection, wherein while controlling the switching portion to establish the second connection in the normal process, the processor adjusts the connection period in response to the zero-cross signal.

10. An image forming device comprising:

a heating device comprising:

a heater having a first terminal and a second terminal, the first terminal being configured to be connectable to one terminal of an alternating current source;

an adjustment portion configured to selectively establish and disconnect a first connection between the second terminal and another terminal of the alternating current source;

a switching portion configured to selectively establish and disconnect a second connection between the heater and the alternating current source; and a generating circuit having a third terminal and a fourth terminal, the third terminal being connected to the one terminal of the alternating current source, the fourth terminal being connected between the second terminal and the adjustment portion, the generating circuit being configured to generate a zero-cross signal indicating a zero-cross timing concerning output of the alternating current source;

an image forming unit configured to form an image on a recording sheet in response to image data; and a processor configured to:

adjust a connection period during which the adjustment portion establishes the first connection;

detect a state of the adjustment portion in response to the zero-cross signal; and perform an error process when the detected state of the adjustment portion indicates that the adjustment portion cannot disconnect the first connection.

11. The image forming device according to claim 10, wherein when the processor is activated, the processor adjusts the connection period and detects the state of the adjustment portion, wherein when performing the error process, the processor prohibits the image forming unit from starting formation of the image.

12. The image forming device according to claim 11, wherein the processor is further configured to perform a normal process in which the processor controls the image forming unit to form the image on the recording sheet when the detected state of the adjustment portion indicates that the adjustment portion can disconnect the first connection, wherein when performing the normal process, the processor is further configured to:

control the switching portion to establish the second connection; and adjust a period during which the heater is powered by the alternating current source by adjusting the connection period on the basis of the zero-cross signal.

* * * * *